United States Patent [19]

Nakada et al.

[11] 4,417,494

[45] Nov. 29, 1983

[54] AUTOMATIC PERFORMING APPARATUS OF ELECTRONIC MUSICAL INSTRUMENT

[75] Inventors: Akira Nakada, Hamamatsu; Eisaku Okamoto, Hamakita; Kiyoshi Yoshida, Hamamatsu, all of Japan

[73] Assignee: Nippon Gakki Seizo Kabushiki Kaisha, Hamamatsu, Japan

[21] Appl. No.: 304,009

[22] Filed: Sep. 21, 1981

[30] Foreign Application Priority Data

Sep. 19, 1980 [JP] Japan ..... 55-130139

[51] Int. Cl.[3] ..... G10F 1/00

[52] U.S. Cl. ..... 84/1.03; 84/1.28; 84/1.19

[58] Field of Search ..... 84/1.28, 1.03, 1.01, 84/1.19, 1.24

[56] References Cited

U.S. PATENT DOCUMENTS

| | | | |
|---|---|---|---|
| 4,132,141 | 1/1979 | Campbell et al. | 84/1.28 |
| 4,172,403 | 10/1979 | Campbell et al. | 84/1.28 |
| 4,355,559 | 10/1982 | Uya et al. | 84/1.03 |
| 4,375,776 | 3/1983 | Okamoto | 84/1.03 |

*Primary Examiner*—F. W. Isen

*Attorney, Agent, or Firm*—Oblon, Fisher, Spivak, McClelland & Maier

[57] ABSTRACT

An automatic performing apparatus of an electronic musical instrument comprises a memory for storing musical note data representing progression of a music to be played and control data for controlling such a generation mode of music tones being generated as tone color and modulation effect. The generation mode of musical tone signals generated by a tone forming circuit in response to the musical note data read out of the memory is also automatically controlled by the control data read out of the memory.

2 Claims, 8 Drawing Figures

10
10a
READER
11
12
DATA MEMORY
DIS
FINISH DET.
49
36
I. C. DET.
43
DIFF.
42
LATCH
23
24
ADDRESS COUNTER
13
R
S Q
R
22
44
IC
S
16
R Q
IC
17
48
DIFF.
47
COMP.
45
DURATION COUNTER
CK
R
18
27
26
DIFF.
KON
20
D Q
29
Q R
S
28
30
IC
19
FIN
21
DIFF.
"1"
14(START)
SS
15
"1"
"0"
35
I. C. DET.
+V
64
62
41
TP
VCO
D/A
DECODE
LATCH
46
65

I. C. DET.
31
LATCH
37
DECODE
50
51a
"1"
SOUND SYSTEM
KON
U K (KSW)
25
SELECT
51
MELODY TONE GEN.
52
32
38
53
33
39
54
ROM
55
55a
59
CHORD TONE GEN.
L K (KSW)
57
56a
60
58
P K (KSW)
BASS TONE GEN.
56
34
40
61
69a
68
67
IC
FIN
S
Q
R
SS
COUNTER
66
PATTN MEMORY
63
RHYTHM TONE GEN.
69

AUTOMATIC PERFORMING APPARATUS OF ELECTRONIC MUSICAL INSTRUMENT

BACKGROUND OF THE INVENTION

1. Field of the Invention

The present invention relates to an automatic performing apparatus of an electronic musical instrument which reads out performance information stored on an appropriate recording medium and generates tone signals according to the performance information.

2. Description of the Prior Art

An automatic performing apparatus of this type is provided with a memory to store performance information read out from the recording medium. The memory successively stores musical note data including pitch data and duration data with progression of a melody. Note data are successively read out of the memory at time intervals corresponding to note durations, and musical tone signals having pitches corresponding to the pitch data read out are formed. Such an automatic performing apparatus may be provided with an auto rhythm playing device, and the note duration is measured by a tempo clock signal used for rhythm generation. An example of such apparatus is disclosed in our copending U.S. patent application Ser. No. 217,896 filed on Dec. 18, 1980 and assigned to the same assignee with the present application. Such a prior automatic performing apparatus is designed only for automatically generating a musical tone signal corresponding to each melody note. It is desirable, however, that tone colors of generated tone signals and/or modulation effects such as vibrato or tremolo, that is, generation modes of tone signals, can be set automatically. It is also desirable that rhythm patterns, start control, tempo control in an automatic rhythm performance be selected automatically.

A performance by the automatic performing apparatus is naturally used as an exemplary one for a novice player. Therefore, from this aspect too, the generation mode of the automatically performed musical tones is desirable to be set automatically so that the generation mode of musical tones is also exemplary.

SUMMARY OF THE INVENTION

Accordingly, an object of the present invention is to provide an automatic performing apparatus which can generate musical tones in exemplary generation modes.

Another object of the invention is to provide an automatic performing apparatus which can automatically control a generation mode of musical tones by automatic performance data.

An automatic performing apparatus according to the present invention is provided with a memory means for storing musical note data and control data for controlling generation modes of musical tones which are recorded on a recording medium and read out thereof. In response to the musical note data read out of the memory means, a melody tone forming means generates a musical tone signal and a generation mode of the musical tone signal is controlled by the control data.

According to an embodiment of the present invention, the musical note data and the control data for automatic performance are stored in a common memory, and those are successively read out with the progression of a melody. Particularly, each control data is stored at such a memory location that the control data is read out at the timing that the generating mode of the music tone is to be changed. Therefore, the control data which has been last read out determines the generating mode of the musical tone signal until new control data is read out.

DETAILED DESCRIPTION OF THE PREFERRED EMBODIMENTS

Figures 1, 1A, 1B:
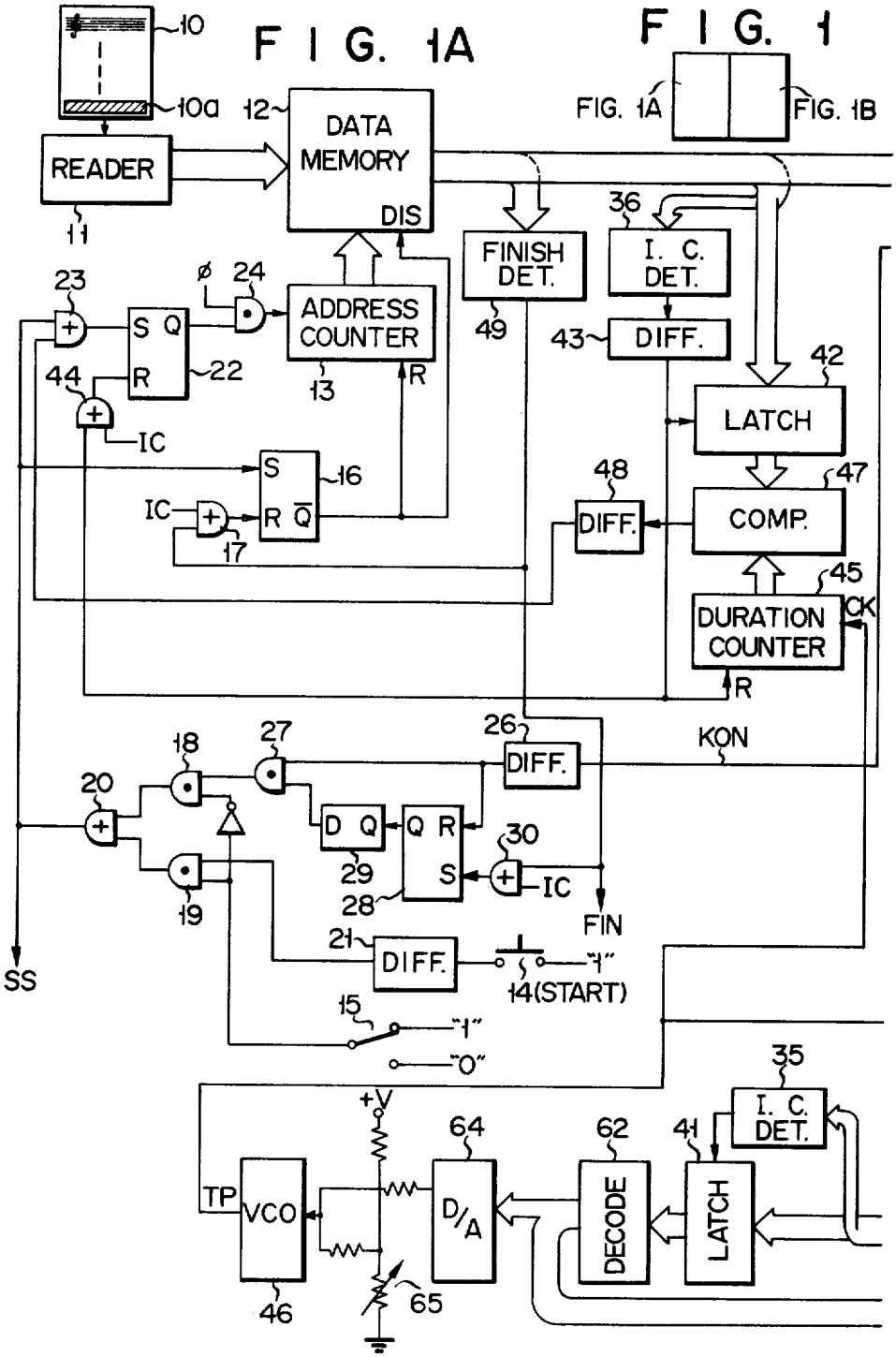
FIGS. 1A and 1B, taken together as in FIG. 1, show an embodiment of an automatic performing apparatus according to the present invention.
Figure 1B:
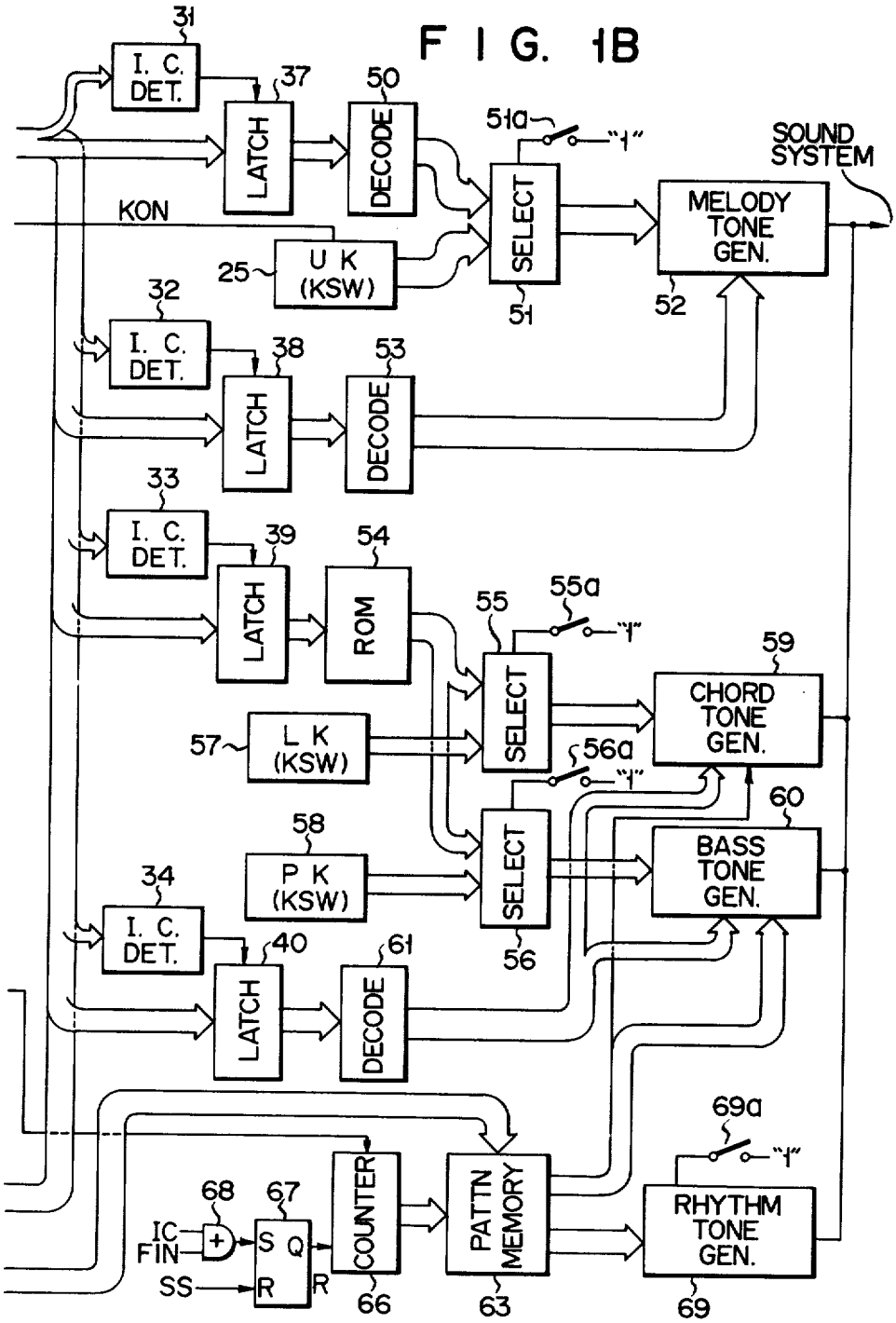
Figure 2:
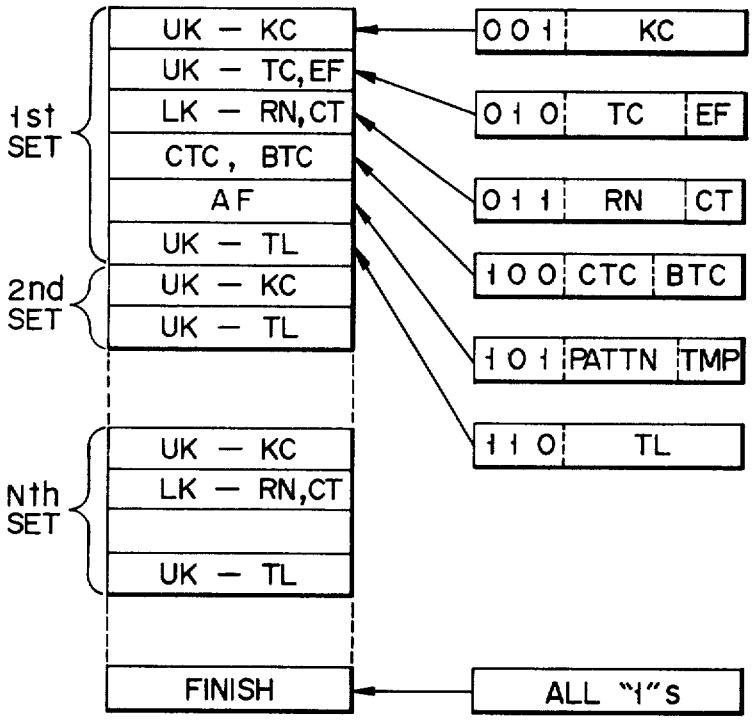
FIG. 2 diagrammatically illustrates an arrangement of plural sets of data words constituting note information.

Referring to FIGS. 1A and 1B, taken together as in FIG. 1, there is shown an embodiment of an automatic performing apparatus of the invention. A magnetic recording medium 10*a* such as a magnetic tape is provided on a music sheet 10. Performance information representing a music on the music sheet is recorded in digital form in such a data format as shown in FIG. 2. The recording medium of other type such as a bar-code printing and a punched sheet may be used instead of the magnetic tape. The performance information is read out by a reader 11 and then stored in a data memory 12. The performance information comprised of plural sets of data words as shown in FIG. 2 are stored in respective addresses of the memory. Each set of data words includes at least musical note data comprising an upper-keyboard key code (UK-KC) and an upper-keyboard duration (time length) code (UK-TL), and further includes control data comprising an upper-keyboard tone color/effect code (UK-TC, UK-EF), a root note/chord type code (LK-RN, LK-CT), a chord/bass tone color code (CTC, BTC) and an auto function code (AF), if necessary. The upper-keyboard key code (UK-KC) corresponds to the pitch of a melody tone to be sounded. The upper-keyboard duration code (UK-TL) represents the duration of the melody tone. The upper-keyboard color/effect code (UKTC, UK-EF) designates the tone color of melody tones being sounded and tone effect (modulation) thereof and the code (LK-RN, LK-CT) designates the root note and a chord type of a chord usually played on a lower keyboard. The code (CTC, BTC) designates a tone color of chord tones and bass tones, and the code (AF) indicates a sound pattern and tempo for automatic performance of chord, bass and rhythm.

In each set of data words, a key code is arranged at the head of set, and a duration code is arranged at the end. Other codes are inserted properly between the key bode and the duration code. Namely, the codes (UK-TC, UK-EF), (LK-RN, LK-CT), (CTC, BTC) and (AF) do not necessarily have to be stored in all the sets, but have only to be stored in sets where generation mode of musical tone signals is desired to be changed. As for the code (UK-TC, UK-EF), for example, the code is first arranged in the first set to designate a tone color and an effect of melody tones, to be generated and next stored in a set where the tone color and the effect should be changed. Therefore, the codes (UK-TC, UK-EF), (LK-RN, LK-CT), (CTC, BTC) and (AF) do not have to be inserted in every set of data words.

Each data word mentioned above is accompanied by an identifying code DC. The data words can be distinguished by identifying codes DC as shown below.

| code | identifying code |
|---|---|
| UK-KC | 0 0 1 |
| UK-TC, UK-EF | 0 1 0 |
| LK-RN, LK-CT | 0 1 1 |
| CTC, BTC | 1 0 0 |
| AF | 1 0 1 |
| UK-TL | 1 1 0 |

A data word "FINISH" indicates the end of performance information, and has bits of all "1".

The performance information stored in data memory 12 is successively read out every set of the data words by an address counter 13.

A read-out operation of address counter 13 is started by the operation of a start switch 14 or the first key operation on the upper keyboard according to a state of a start mode changing switch 15. When a power source is turned on, an initial clear signal IC is generated. The signal IC resets a flip-flop circuit 16 through an OR circuit 17. As a result, an output Q of flip-flop circuit 16 goes low to disable memory 12 and to reset address counter 13.

A normal start mode, in which the start mode changing switch 15 is positioned as illustrated, will be described. Under this condition, an output signal of the switch 15 is "1". Therefore, an AND circuit 18 is disabled while another AND circuit 19 is enabled. When the start switch 14 is turned on under this condition, a "1" output signal is differentiated by a differentiator 21. The differentiated output is produced as a start signal SS from the AND circuit 19 and the OR circuit 20. The start signal SS sets the flip-flop circuit 16 and also sets a flip-flop circuit 22 by way of an OR circuit 23. When the flip-flop circuit 16 is set, the memory 12 and the address counter 13 are enabled. When the flip-flop circuit 22 is set, an AND gate 24 which is supplied with clock pulses $\phi$ generated by an appropriate source (not shown) is enabled to allow the pulses $\phi$ to be applied to the address counter 13. As a result, the data read-out operation from the memory 12 starts.

Next will be described a synchro start mode in which the start mode changing switch 15 is switched to the opposite position to the illustrated one. In this mode, irrespective of the operation of the start switch 14, the read-out operation is started by a key operation on the upper keyboard. In the synchro start mode, contrary to the case of the start mode as mentioned above, the AND circuit 18 is enabled, while the AND circuit 19 is disabled. Under this condition, if any of the keys on the upper keyboard is operated, a key-on signal KON is produced from an upper keyboard key switch circuit 25, and the signal KON is differentiated in a differentiating circuit 26. The differentiated output is applied to an AND circuit 27 and the reset input of a flip-flop circuit 28. The other input of the AND circuit 27 is connected with an output Q of a flip-flop circuit 28 via a D type flip-flop circuit 29. Since the flip-flop circuit 28 was set by the initial clear signal IC supplied through an OR circuit 30, the AND circuit 27 has been enabled. Therefore, the differentiated pulse of the differentiating circuit 26 is taken out as the start signal SS. When a pulse corresponding to the first key operation is produced from the differentiating circuit 26, the flip-flop circuit 28 is reset. As a result, the AND circuit 27 is disabled. Accordingly, the succeeding key operation produces no start signal SS. In the synchro start mode, like the above-mentioned start mode, the read-out operation of data from the memory 12 is started in response to the start signal SS generated by the first key operation.

In response to the count of clock pulses $\phi$ by the address counter 13, the first set of data, such as the upper-keyboard key code (UK-KC), the upper-keyboard tone color/effect code (UK-TC, EF), the root note/chord type code (LK-RN, LK-CT), the chord-/bass tone color code (CTC, BTC), the auto function code (AF) and the upper-keyboard duration code (UK-TL), are successively read out along with their respective identifying codes from the data memory 12.

The data read out of the memory 12 is applied to identifying code detectors 31 to 36 and latch circuits 37 to 42. The identifying code detector 31 detects the code "001". Then, the latch circuit 37 latches the upper-keyboard key code (UK-KC) in response to a detecting signal of the detector 31. The identifying code detector 32 detects the code "010". Accordingly, the latch circuit 38 latches the upper-keyboard tone color/effect code (UK-TC, EF) in response to a detecting signal of the detector 32. The identifying code detector 33 detects the code "011", so that the latch circuit 39 latches the root note/chord type code (LK-RN, CT). The identifying code detector 34 detects the identifying code "100". Then, the latch circuit 40, responsive to the detector 34, latches the chord/bass tone color code (CTC, BTC). The identifying code detector 35 detects the code "101". Therefore, the latch circuit 41 latches the auto function code (AF). The identifying code detector 36 detects the code "101". And the latch circuit 42, responsive to a differentiator 43 which differentiates detecting signal of the detector 36, latches the upper-keyboard duration code (UK-TL).

When the upper-keyboard duration code (UK-TL) is read out, the differentiator 43 connected to the identifying code detector 36 generates an output pulse which resets the flip-flop circuit 22 via an OR circuit 44. As a result, the supply of clock pulses $\phi$ to the address counter 13 is stopped, and the read-out of the first set of data is accomplished.

The output signal of the differentiating circuit 43 resets a duration counter 45. The counter counts tempo pulses TP produced by a voltage-controlled oscillator (VCO) 46.

The count of the duration counter 45 is compared with a duration code latched by the latch circuit 42 by a comparator 47 which measures a time length during which a musical tone indicated by the upper-keyboad key code should be sounded. After the time length indicated by the duration code, the comparator 47 produces an output signal which is differentiated by a differentiator 48, and sets the flip-flop circuit 22 by way of the OR circuit 23. As a result, the clock pulse $\phi$ is supplied to the address counter 13. Then, the second set of data is read out of the memory 12. As shown in FIG. 2, the second set data includes only the key code and the duration code. These codes are respectively latched by the latch circuits 37 and 42, as mentioned above. The codes which have been latched by other latch circuits remain unchanged.

Thus, note information is read out every set. Finally, the FINISH code of all "1"s is read out. The FINISH code is detected by a detector 49 to produce a finish signal FIN. The finish signal FIN resets the flip-flip circuit 16, disables the memory 12, and resets the address counter 13. Also, the finish signal FIN sets the flip-flop circuit 28.

The musical tones to be generated are determined by the codes latched by the latch circuits 37 to 41. The key code latched by the latch circuit 37 is decoded by a decoder 50 so that one of forty-eight outputs, for example, goes high. Outputs of the decoder 50 and the outputs of the upper keyboard switch circuit 25 are selectively connected by a selector 51 to a melody tone generating circuit 52. The selector 51 selects either of automatic performance or manual performance of melody tones by a switch 51*a*. For example, when the switch 51*a* is OFF, the selector 51 couples the outputs of the upper keyboard switch circuit 25 to the melody tone generating circuit 52, thereby to produce musical tones by operating the upper keyboard. Conversely, when the switch 51*a* is ON, the melody tone generating circuit 52 generates musical tones designated by the key codes read out of the memory 12.

The upper-keyboard tone color/effect code (UK-TC, EF) latched by the latch circuit 38 is decoded by a decoder 53 whose outputs are coupled to the melody tone generating circuit 52. As a result, the melody tone generating circuit 52 imparts the designated tone color and effect (modulation) to a musical tone being generated.

Figure 3:
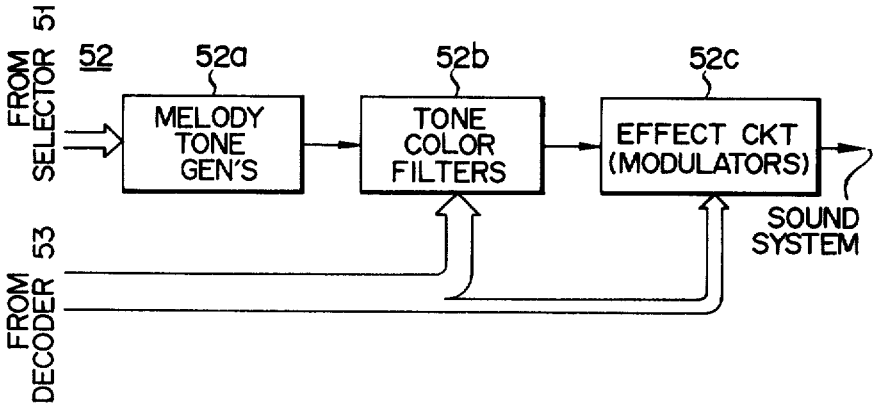
FIG. 3 shows a block diagram of a melody generating circuit used in the apparatus shown in FIG. 1.

Referring to FIG. 3, there is shown the melody tone generating circuit 52 which includes 48 tone generators 52*a*, for example, a plurality of tone coloring filters 52*b* and a plurality of effect imparting circuits or modulation circuits 52*c*. One of 48 tone generators is selected by an output of the selector 51 to be coupled with the tone coloring filters 52*b*. One of the tone coloring filters is selected by an output signal corresponding to the tone color code from the decoder 53. The selected filter is coupled with the modulation circuits 52*c*, which imparts effects such as tremolo, chorus, ensemble, reverberation and vibrato to a tone-colored signal. One of the modulation circuits 53 is selected by an output signal correspondng to the effect designating code from the decoder 53.

The root note/chord type code (LK-RN, CT) latched in the latch circuit 39 is applied to a read only memory (ROM) 54. The ROM 54 stores signal indicating pitches of tones composing a chord and signals for forming bass tones (a signal indicating a pitch of a root note and a signal designating a chord type). The signal indicating the pitches of the tones composing the chord read out from the ROM 54 is supplied to a selector 55, while the signal for forming bass tones is supplied to a selector 56. The selector 55 is connected to a lower keyboard switch circuit 57. On the other hand, the selector 56 is connected to a pedal keyboard switch circuit 58. The selector 55 is provided for selecting either of automatic performance or manual performance of chords. The selector 56 is provided to select either of automatic performance or manual performance of bass tones. Therefore, as in the case of the selector 51, switches 55*a* and 56*a* are connected to the selectors 55 and 56, respectively.

Outputs from the selectors 55 and 56 are coupled with a chord generating circuit 59 and a bass tone generating circuit 60, respectively, so that designated chord tones and bass tones are generated.

The chord/bass tone color code (CTC, BTC) representing the tone colors of the chord tones and the bass tones latched in the latch circuit 40 is decoded by a decoder 61 whose outputs are coupled with the chord tone generating circuit 59 and the bass tone generating circuit 60, respectively.

The auto function code (AF) latched by the latch circuit 41 is decoded by a decoder 62. Pattern designating decoded outputs of the decoder 62 are coupled with a pattern memory 63. Tempo designating decoded outputs of the decoder 62 are applied to a digital-to-analog (D/A) converter 64 which produces, an analog voltage corresponding to the tempo designating code. The analog voltage, together with an output voltage of a variable resistor 65 for manual adjusting connected with the power source, is applied to the VCO 46 as mentioned above to control its oscillating frequency (tempo).

The pattern memory 63 is comprised of a ROM storing rhythm patterns, chord-tone generating patterns and bass patterns. The pattern memory 63 receives a count output of a counter 66 which counts tempo pulses TP, as an address signal. Then, the memory 63 successively produces a rhythm pattern pulse, a chord tone sound timing pattern pulse and a bass pattern signal, which are designated by pattern designating information.

The counter 66 has its reset terminal R coupled with the output Q of a flip-flop circuit 67 whose set terminal S is supplied with an initial clear signal IC and a performance finish signal FIN through an OR circuit 68. A start signal SS is applied to the reset terminal R of the circuit 67. The counter 66 is enabled to count the tempo pulses TP when the flip-flop circuit 67 is reset by the start signal SS.

The chord tone sounding timing pattern pulses read out of the pattern memory 63 are applied to the chord tone generating circuit 59, and the bass pattern signal is applied to the bass tone generating circuit 60. The rhythm pattern pulse is applied to a rhythm tone generating circuit 69. The chord tone sounding timing pattern pulses read out of the pattern memory 63 determine timings that auto chord tones should be sounded. The base pattern signal determines timings that auto bass tones should be sounded, and designates musical intervals of the third and the fifth note for the root note of a chord. And the rhythm pattern pulse determines a timing when an auto rhythm tone should be sounded and selects a rhythm tone generator.

The chord tone generating circuit 59 receives signals designating pitches of the chord tones from the selector 55, a signal designating a tone color of the chord tones from the decoder 61 and the chord tone sound timing pulse from the pattern memory 63 so as to generate chord tones in a designated mode.

Figure 4:
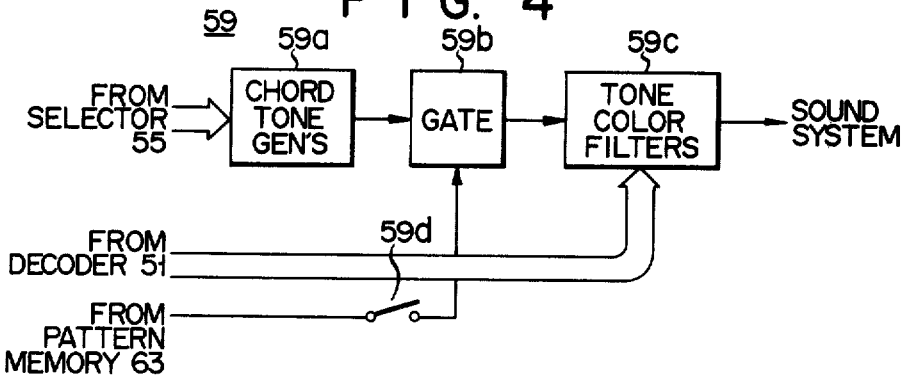
FIG. 4 shows a block diagram of a code tone generating circuit used in the apparatus in FIG. 1.

As shown in FIG. 4, the chord tone generating circuit 59 is comprised of tone generators 59*a*, a gate circuit 59*b*, tone coloring filters 59*c* and a chord sounding control switch 59*d*, for example. Namely, by the output signals representing a chord from the selector 55, the tone generators forming a chord is selectively connected to the gate circuit 59*b*. The gate circuit 59*b* gates the chord tone signals in response to the sound timing pattern pulse supplied from the pattern memory 63 via the switch 59*d*. In response to an output signal of the decoder 61, an output signal of one of the tone coloring filters 59*c* is selectively derived.

Upon receipt of a signal representing a pitch of a bass tone to be sounded or a signal for forming a bass tone (a signal which indicates the pitch of root tone and chord type) from the selector 56, a tone color designating signal and a bass pattern signal derived from the pattern memory 63, the circuit 60 forms a bass tone signal.

Figure 5:
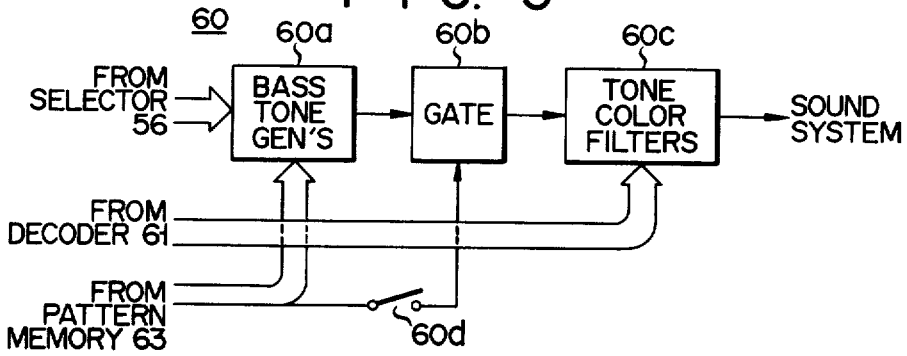
FIG. 5 shows a block diagram of a bass tone generating circuit used in the apparatus in FIG. 1.

As shown in FIG. 5, the bass tone generating circuit 60 is comprised of bass tone generators 60*a*, a gate circuit 60*b*, tone coloring filters 60*c* and a sound control switch 60*d*, for example. Namely, by the signal representing the pitch of root note and a chord type from the selector 56 and a bass pattern signal (indicating musical intervals of the third and fifth notes for the root note) read out of the pattern memory 63, the tone generators for forming designated bass tones are selectively coupled with the gate circuit 60*b*. The gate circuit 60*b* gates the bass tone signals in response to the bass pattern signal (indicating timing that the bass tone is sounded) from the pattern memory 63. By the tone color designating signal from the decoder 61, an output signal of one of the coloring filters 60*c* is selectively derived.

Since a device for forming bass tone signals by a signal designating the pitch of root note, a signal designating a chord type and a bass pattern signal is well known, no explanation will be given in detail in this specification.

A rhythm tone generating circuit 69 forms a rhythm tone signal on the basis of a rhythm tone pulse read out of the pattern memory 63. Namely, the rhythm tone generating circuit 69 has a plurality of rhythm tone generators, and a tone signal from one of the generators is selectively led out by the rhythm pattern pulse. A switch 69*a* is provided for controlling the generation of rhythm tones.

Output signals of the melody tone generating circuit 52, the chord tone generating circuit 59, the bass tone generating circuit 60 and the rhythm tone generating circuit 68 are supplied to a sound system (not shown).

In this way, the generation mode of melody tones, chord tones, bass tones and rhythm tones is controlled. A tone color/effect of melody tones, auto chord tones, and auto bass tones, generation pattern and tempo of these chord and bass tones are controlled by of the data latched in the latch circuits 38 to 41. The data in these latch circuits are rewritten only when the corresponding data are newly read out of the data memory 12. Therefore, so far as any new control data is not read out, the generation mode of musical tone is not changed.

Figure 6:
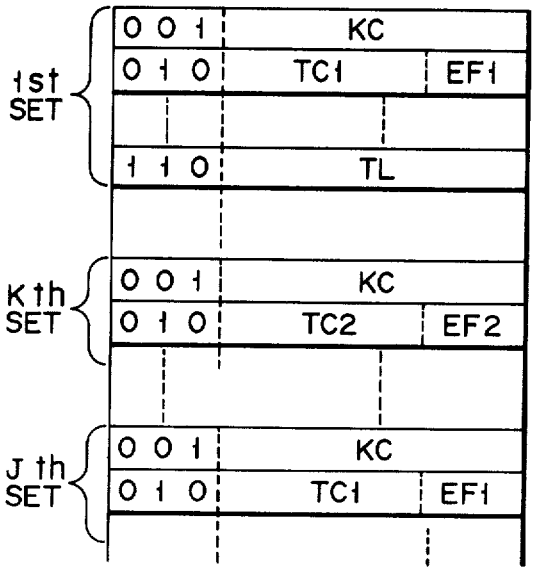
FIG. 6 diagrammatically illustrates data sets for explaining the operation of the apparatus of FIG. 1.

For example, when the upper keyboard tone color-/effect data ($UK\text{-}TC_1$, $EF_1$), ($UK\text{-}TC_2$, $EF_2$) ($UK\text{-}TC_1$, $EF_1$) are inserted into the first set, the Kth set and the Jth set, respectively, as shown in FIG. 6, the tone color-effect of the melody tones from the first set to the (K-1)th set are controlled by the data ($UK\text{-}TC_1$, $EF_1$), and the tone color/effect of the melody tones from the Kth to the (J-1)th set are controlled by the data ($UK\text{-}TC_2$, $EF_2$), and the generation mode of the melody tones of the Jth set and the subsequent sets are again controlled by the data ($UK\text{-}TC_1$, $EF_1$).

After those sets of the data are successively read out in this way, the finish code is read out and detected in the detecting circuit 49, to produce the play finish signal FIN. The finish signal FIN resets flip-flop circuit 16, so that the memory 12 is disabled and the counter 13 is reset. The finish signal FIN also sets the flip-flop circuit 67 and resets the counter 66. Then, the read-out of the data from the pattern memory 63 terminates.

According to the embodiment as mentioned above, the generation modes of the melody tone, the bass tone and the rhythm tone may be changed at will by so forming the performance information on the recording medium 10*a*. In other words, the change of the generation mode is automatically performed by inserting data concerning the generation mode into a desired data set where the change should be done.

In the above-mentioned embodiment, the upper-keyboard tone color/effect data, the root note/chord type data, the chord/bass tone color data and the auto function data are used as the generation mode control data. The present invention, however, is not limited to those data. In other words, the number of types of control data may be more or less than four. Further, the data format of the automatic performance information stored in the recording medium and the data memory may be variously altered as understood by a skilled in the art.

In the above embodiment, the recording medium 10*a* is formed on a music sheet. However, the recording medium may be such other external memory means as a memory module which is detachably attached to the electronic musical instrument.

What is claimed is:

1. An automatic performing apparatus of an electronic musical instrument comprising:

memory means for storing performance data read out from a recording medium external to said performing apparatus, said data representing a progression of music to be played and comprising pitch sub-data representing pitches of notes of said music, duration sub-data representing durations of said notes and control sub-data for controlling a generation mode of the music to be played which pertains to at least one of a tone color, a modulation effect, a rhythm and a tempo, said sub-data each having an identifying code which distinguishes between the respective sub-data wherein said control sub-data is stored at memory locations which allows the control sub-data to be read out from said memory means only at a time when the tone generation mode is to be changed;

read-out means for successively reading out the performance data from said memory means in accordance with the progression of the music wherein said read-out means comprises means responsive to said identifying code for distinguishing the respective sub-data in the performance data and means responsive to the duration sub-data of each note to read out the pitch sub-data of the next note every time the duration of each note lapses after the pitch sub-data is read out;

first latch means for latching the pitch sub-data and the duration sub-data both read out from said memory means, the sub-data latched in the first latch means being updated every time new pitch sub-data and new duration sub-data are read out from memory means;

second latch means for latching said control sub-data read out from said memory means, the control sub-data latched in the second latch means being updated only when the generation mode of the music is changed;

tone signal generating means for generating musical tone signals in response to the pitch sub-data and the duration sub-data latched in said first latch means; and means for controlling the generation mode of the music in response to the control sub-data latched in said second latch means.

2. An automatic performing apparatus of an electronic musical instrument comprising:

memory means for storing performance data read out from a recording medium external to said performing apparatus, said data representing a progression of a music to be played and comprising pitch sub-data representing pitches of notes of said music, duration sub-data representing durations of said notes and control sub-data for controlling a generation mode of the music to be played which pertains to a least one of a tone color, a modulation effect, a rhythm and a tempo, said sub-data each having an identifying code which distinguishes between the respective sub-data wherein said performance data is stored in said memory as a set of sub-data which set includes said control sub-data only when the generation mode of the music is to be changed;

read-out means for successively reading out the performance data from said memory means in accordance with the progression of the music wherein said read-out means comprises means responsive to said identifying code for distinguishing the respective sub-data in the performance data and means responsive to the duration sub-data of each note to read out the pitch sub-data of the next note every time the duration of each note lapses after the pitch sub-data is read out;

tone forming means for forming musical tone signals in response to the pitch sub-data read out of said memory means and distinguished by said distinguishing means; and means for controlling the generation mode of the music in response to said control sub-data read out of said memory means and distinguished by said distinguishing means.

* * * * *